United States Patent [19]

Takayama et al.

[11] 4,108,786

[45] Aug. 22, 1978

[54] MAGNETIC DRY DEVELOPER FOR ELECTROSTATIC PHOTOGRAPHY AND PROCESS FOR PREPARATION THEREOF

[75] Inventors: Hiroshi Takayama, Moriguchi; Tatsuo Aizawa, Osaka, both of Japan

[73] Assignee: Mita Industrial Company Ltd., Osaka, Japan

[21] Appl. No.: 641,285

[22] Filed: Dec. 16, 1975

[51] Int. Cl.[2] ..... G03G 9/14

[52] U.S. Cl. ..... 252/62.1 P; 96/1 SD; 252/62.1 R; 252/62.53; 252/62.54; 252/513; 252/519; 427/18

[58] Field of Search ..... 427/18; 96/1 SD; 252/62.1 P, 62.54, 62.53, 62.1 R, 513, 519

[56] References Cited

U.S. PATENT DOCUMENTS

| | | | |
|---|---|---|---|
| 2,718,506 | 9/1955 | Ellemen | 252/513 |
| 2,890,968 | 6/1959 | Giaimo | 252/62.54 |
| 3,042,616 | 7/1962 | Brown | 252/62.54 |
| 3,052,564 | 9/1962 | Kulesza | 427/18 |
| 3,093,039 | 6/1963 | Rheinfrank | 252/62.1 P |
| 3,133,023 | 5/1964 | Vogel | 252/62.54 |
| 3,485,758 | 12/1969 | Borucki et al. | 252/62.54 |
| 3,520,811 | 7/1970 | Swoboda | 252/62.54 |
| 3,627,682 | 12/1971 | Hall et al. | 252/62.1 |
| 3,639,245 | 2/1972 | Nelson | 252/62.1 P |
| 3,698,005 | 10/1972 | Nacci et al. | 427/18 |
| 3,766,096 | 10/1973 | Mastrangelo | 252/62.54 |

*Primary Examiner*—Ralph S. Kendall
*Assistant Examiner*—John D. Smith
*Attorney, Agent, or Firm*—Sherman & Shalloway

[57] ABSTRACT

A magnetic toner for electrostatic photography consisting essentially of spherical particles of a composition comprising a fine powder of a magnetic material having an average particle size not exceeding 1000 mμ and being dispersed in a binder resin, said powdery magnetic material being present in an amount of 25 to 75% by weight based on the composition, spherical particles of said composition having such a particle size distribution that particles having a particle size larger than 44 μ occupy up to 10% of the total particles and particles having a particle size smaller than 2 μ occupy up to 10% of the total particles, wherein said fine powder of the magnetic material is distributed predominantly in the surface layer portion of each spherical particle and said spherical particles have a volume resistivity not higher than $1 \times 10^{11}$ Ω-cm as measured in a magnetic field of about 680 gauss under a voltage of 1000 V.

12 Claims, No Drawings

MAGNETIC DRY DEVELOPER FOR ELECTROSTATIC PHOTOGRAPHY AND PROCESS FOR PREPARATION THEREOF

This invention relates to a developer for electrostatic photography and to a process for the preparation thereof. More particularly, the invention relates to a magnetic developer for electrostatic photography having excellent electric and magnetic characteristics which comprises fine particles of a magnetic material distributed predominantly on surface layers of toner particles, and to a process for the preparation of this developer for electrostatic photography.

Known developers of the dry type (toners) heretofore used for developing electrostatic latent images formed by electrostatic photography or the like include so-called magnetic toners capable of performing development without the aid of a particular carrier. These magnetic toners are generally prepared by dispersing powder of a magnetic material such as triiron tetroxide, if necessary with additives such as a pigment, into a medium of a binder resin and molding the dispersion into granules. In order to improve the conductivity in these magnetic toners, there has generally been adopted a method in which the amount of a conductive component is increased in the above dispersion to be molded into particles or a method in which a conductive substance such as carbon black is embedded in the resulting granular product to thereby form particles having a conductivity imparted to surfaces thereof and having such a property that the particles as a whole can be magnetically attractable.

These magnetic toners have the advantage that clear toner images with a much reduced edge effect can be produced according to the magnetic brush development method without using a magnetic carrier or the like. However, the production of these magnetic toners involves various difficulties. More specifically, the known process for the production of magnetic toners involves complicated steps of uniformly dispersing powder of a magnetic material, optionally with a pigment such as carbon black, into a melt of a binder resin medium, cooling and finely pulverizing the molten mixture and molding the pulverized mixture into fine particles under the application of heat. Further, magnetic toner particles prepared according to this conventional process have a very broad particle size distribution range. When magnetic toners containing particles of a large particle size are employed, the resolving power is low in developed copies, and when magnetic toners containing particles of an extremely small particle size are employed, so-called fog is caused on development. Accordingly, in magnetic toners prepared according to the conventional process, the particle size should inevitably be adjusted by seiving or the like, resulting in reduction of yields of toners.

In one type of the above-mentioned known magnetic toners, a powdery magnetic material or particulate carbon black or the like is coated with an electrically insulating resin, and the toner of this type is poor in conductivity and provides only copied images with a high edge effect. Accordingly, in another type of the known magnetic toners, in order to overcome this defect, there is adopted a complicated operation of embedding particles of a conductive substance such as carbon black completely into surfaces of the toner particles.

In accordance with this invention, there is provided a developer for electrostatic photography which is quite different from the foregoing known magnetic toners in the detailed structure and properties of the particles. More specifically, the developer for electrostatic photography according to the present invention consists essentially of a composition of fine particles of a magnetic material dispersed in a binder resin medium, and it has such a structural characteristic that fine particles of the magnetic material are distributed predominantly in surface areas of spherical particles of said composition. In the developer of the present invention, if triiron tetroxide is used as a magnetic material, the volume resistivity is at a relatively low level of not higher than $1 \times 10^{11}$ Ω-cm, which is very suitable for the magnetic toner. Of course, the electric characteristics of the toner of the present invention may optionally be adjusted by performing various surface treatments such as mentioned below.

The particulate form of the magnetic toner of the present invention is substantially spherical and its particle size distribution range is so narrow that particles having a size larger than 44 μ occupy up to 10% of total particles and particles having a size smaller than 2 μ occupy up to 10% of total particles. Accordingly, the magnetic toner of the present invention is very uniform in the particle size, and it has a desirable particle flowability when it is handled and manifests a high resolving power and a high resistance to background contamination in combination.

The developer for electrostatic photography according to the present invention can easily be fixed on a copying paper by customary heat-fixing means, and it has a novel characteristic property that it can readily be fixed on a copying paper under a relatively low pressure. More specifically, since in the developer of the present invention particles of a magnetic material are predominantly distributed on surface layers of spherical toner particles to provide crater-like rough surfaces, the developer of the present invention has a sufficient anchoring effect to a photosensitive layer or coating of a copying paper even under a relatively low pressure. Moreover, since the fine powder of the magnetic material is predominantly distributed on the surface layer portion of each spherical toner particle, a relatively large void is present in each spherical particle and the developer of the present invention has such a specific property that it can readily be broken and ground. Because of this characteristic property, it is readily embedded in the broken and ground state into the photosensitive layer or coating of a copying paper under application of a pressure at the fixing step and hence, a strongly fixed image is readily formed on the copying paper.

The feature of the developer of the present invention that spherical toner particles have a crater-like rough surface (confirmed by a large oil absorption and a microscopic photograph) and have a relative large void in the interior provides prominent effects also in the customary heat-fixing step. More specifically, in a known magnetic toner comprising a powdery magnetic material uniformly dispersed in a medium of a binder resin, the resin rises on the surface of a toner image in the heat-fixing step to provide an appearance which is shiney to some extent. Because of the above-mentioned feature an image formed by using the developer of the present invention has a soft appearance which is delustered to some extent and the tendency of prints to impart fatigue to eyes of users is drastically reduced.

In accordance with the present invention, the novel developer for electrostatic photography having the above-mentioned various advantages is prepared by a process comprising: mixing a powdery magnetic material having an average particle size not exceeding 1000 mμ with a binder resin dissolved or dispersed in a liquid mixture of a water-miscible organic solvent and a water-immiscible organic solvent, so that the fine powder of the magnetic material occupies 25 to 75% by weight of the final composition; mixing the resulting mixture with an aqueous medium under strong shearing agitation sufficient to cause granulation of the mixture, thus transferring the organic solvents in the particulate mixture into the aqueous medium to thereby distribute the powder of the magnetic material predominantly in the surface layer portions of the spherical particles of said mixture; recovering the so formed particles, water-washing them according to need; and drying the recovered particles under such conditions that the resin binder is not substantially molten.

The finely divided magnetic material has preferably a particle size smaller than 1000 mμ, especially preferably a particle size smaller than 500 mμ. It is also preferred that a finely divided magnetic material having a conductive property be used as such finely divided magnetic material. In case the particle size of the finely divided magnetic material is larger than the above range, it becomes difficult to distribute the magnetic material predominatingly in the surface layer of each spherical particle. Therefore, the intended objects of the present invention cannot be attained by the use of such magnetic material having a large particle size.

In case the magnetic material to be used is one having an electrically conductive property, such as triiron tetroxide, even if particular surface treatment is not conducted, the volume resistivity of the final toner particles can easily be controlled within the range specified in the present invention. In the present invention, it is preferred that a magnetic material having a volume resistivity in the magnetic field of not higher than $1 \times 10^{11}$ Ω-cm, especially not higher than $1 \times 10^{8}$ Ω-cm, as measured according to the method described hereinafter, be used.

As inorganic magnetic materials heretofore used in this field, there can be mentioned, for example, triiron tetroxide ($Fe_3O_4$), diiron trioxide ($\gamma$—$Fe_2O_3$), zinc iron oxide ($ZnFe_2O_4$), ytterium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) and the like. In the present invention, at least one member selected from the foregoing magnetic materials is used so that the above condition is satisfied, and use of powdery triiron tetroxide as the magnetic material is especially preferred for attaining the intended objects of the present invention.

Any of natural, semi-synthetic and synthetic resins and rubbers having a suitable adhesiveness under application of heat or pressure can be used as the resin binder in combination with the above-mentioned magnetic material. These resins may be thermoplastic resins, or uncured thermosetting resins or precondensates thereof. As valuable natural resins, there can be mentioned, for example, balsam, rosin, shellac, copal and the like. These natural resins may be modified with one or more of vinyl resins, acrylic resins, alkyd resins, phenolic resins, epoxy resins and oleoresins (oil resins) such as mentioned below. As the synthetic resin that can be used in the present invention, there can be mentioned, for example, vinyl resins such as vinyl chloride resins, vinylidene chloride resins, vinyl acetate resins and vinyl acetal resins, e.g., polyvinyl acetal; acrylic resins such as polyacrylic acid esters, polymethacrylic acid esters, acrylic acid copolymers and methacrylic acid copolymers; olefin resins such as polyethylene, polypropylene, polystyrene and styrene copolymers; polyamide resins such as nylon-12, nylon-6 and polymeric fatty acid-modified polyamides; polyesters such as polyethylene terephthalate/isophthalate and polytetramethylene terephthalate/isophthalate; alkyd resins such as phthalic acid resins and maleic acid resins; phenolformaldehyde resins; ketone resins; coumarone-indene resins; amino resins such as urea-formaldehyde resins and melamine-formaldehyde resins; and epoxy resins. These synthetic resins may be used in the form of mixtures, for example, a mixture of a phenolic resin and an epoxy resin and a mixture of an amino resin and an epoxy resin.

As the natural and synthetic rubbers that can be used in the present invention, there can be mentioned, for example, natural rubber, chlorinated rubber, cyclized rubber, polyisobutylene, ethylene-propylene rubber (EPR), ethylene-propylene-diene rubber (EPDM), polybutadiene, butyl rubber, styrene-butadiene rubber (SBR), acrylonitrile-butadiene rubber and the like.

The binder resin to be used in the present invention should have a good solubility or dispersibility in a liquid mixture of a water-miscible organic solvent and a water-immiscible organic solvent, which will be detailed hereinafter.

In the present invention, the binder resin medium and the finely divided magnetic material can be mixed at various ratios, but in order to obtain a developer capable of attaining the foregoing objects, it is important that the finely divided magnetic material should be incorporated at such a ratio that the finely divided magnetic material is present in the resulting developer in an amount of 25 to 75% by weight, especially 40 to 60% by weight, based on the spherical toner particles. In case the amount of the finely divided magnetic material is smaller than 25% by weight, it is difficult to impart sufficiently to the spherical particles the above-mentioned property of being magnetically attractable and the above-mentioned surface characteristic. When the amount of the finely divided magnetic material exceeds 75% by weight, the form-retaining property is often degraded in the resulting spherical particles.

In order to improve the color or hue of the spherical toner particles and to extend the spherical toner particles, various dyes, pigments and extender pigments may be incorporated in the present invention. Suitable examples of these dyes, pigments and extender pigments are as follows (each parenthesized number indicates the color index number):

BLACK PIGMENTS:

Carbon black (77265), acetylene black (77266) and Aniline Black (50440)

YELLOW PIGMENTS:

Chrome yellow (77600), zinc yellow (77955), cadmium yellow (77199), yellow iron oxide (77492), Naphthol Yellow S (10316), Hansa Yellow G (11680), Hansa Yellow 10G (11710), Benzidine Yellow GR (21100), Quinoline Yellow Lake (47005), Permanent Yellow NCG (20040) and Tartrazine Lake (19130)

ORANGE PIGMENTS:

Chrome orange (77601), molybdenum orange (77605), Permanent Orange GTR (12305), Pyrazolone Orange (21110), Indanthrene Brilliant Orange RK (59300), Benzidine Orange G (21110) and Indanthrene Brilliant Orange GK (59305)

RED PIGMENTS:

Red iron oxide (77491), cadmium red (77202), red lead (77578), Permanent Red 4R (12120), Lithol Red (15630), Pyrazolone Red (21120), Watchung Red calcium salt (15865), Lake Red D (15500), Eosine Lake (45380), Rhodamine Lake B (45170), Alizarine Lake (58000) and Brilliant Carmine 3B (16105)

VIOLET PIGMENTS:

Manganese violet (77742) and Methyl Violet Lake (42535)

BLUE PIGMENTS:

Ultramarine (77510), cobalt blue (77346), Alkali Blue Lake (42750 A), Victoria Blue Lake (44045), Phthalocyanine Blue (74160), metal-free Phthalocyanine Blue (74100), Fast Sky Blue (74200) and Induthrene Blue BC (69825)

GREEN PIGMENTS:

Chrome Green (77520 + 77600), chromium oxide (77288), Pigment Green B (10006) and Malachite Green Lake (42000)

WHITE PIGMENTS:

Zinc flower (77947), titanium oxide (77891), antimony white (77052) and zinc sulfide (77975)

EXTENDER PIGMENTS:

Baryte powder (77120), barium carbonate (77099), clay (77005), silica (77811), talc (77718) and alumina white (77002)

DYES (BASIC, ACIDIC, DISPERSE AND DIRECT DYES):

Nigrosine (50420), Methylene Blue (52015), Rose Bengale (45440), Quinoline Yellow (47005) and Ultramarine Blue (14880)

It is preferred that these pigments and extender pigments have a particle size equal to or smaller than the size of the finely divided magnetic material, and that they be used in an amount smaller than 50% by weight, especially smaller than 10% by weight, based on the final composition.

In order to shape a composition of the finely divided magnetic material and the binder resin into substantially spherical particles and distribute the fine powder of the magnetic material predominantly in surface layer portions of the resulting toner particles, it is important in the present invention that a mixture of a water-miscible organic solvent and a water-immiscible organic solvent should be used as the solvent for dissolving or dispersing therein the binder resin. When a water-miscible solvent such as lower alcohols is used alone, the shape is quite indefinite in the resulting particles, and these particles are not suitable as magnetic toners as shown in Comparative Example 2. When a water-immiscible solvent such as toluene is used alone, even though spherical particles may be formed, the production efficiency is very low and the particle size distribution is broadened and is skewed to the large particle size side as shown in Comparative Example 3. In contrast, when a mixture of a water-miscible organic solvent and a water-immiscible organic solvent is used according to the present invention, developers having the above-mentioned preferred properties can be prepared, which will readily be understood from Examples given hereinafter.

As the water-miscible organic solvent, there can be mentioned, for example, lower alcohols such as methanol, ethanol and propanol, ketones such as acetone, ethers such as tetrahydrofuran and dioxane, amides such as N,N-dimethylformamide, amines such as morpholine and pyrrolidone, sulfoxides such as dimethylsulfoxide, and other polar organic solvents.

As the water-immiscible organic solvent, there can be mentioned, for example, aromatic hydrocarbons such as benzene, toluene and xylene, halogenated hydrocarbons such as chloroform, carbon tetrachloride, trichlene, perchlene and freon, esters such as ethyl acetate and amyl acetate, higher alcohols such as butanol, ethers such as n-butyl ether and ethyl ether, and ketones such as mesityl oxide and methylamyl ketone. These organic solvents may be used singly or in the form of mixtures of two or more.

The term "water-immiscible organic solvent" used in the present specification does not mean a solvent which is not dissolved in water at all, but a solvent which is slightly soluble in water and can be used in the present invention conveniently. The difference between the water-miscible organic solvent and the water-immiscible solvent referred to in the present invention resides in that the former solvent is miscible with water at an optional ratio but the latter solvent does not possess such property.

As the combination of such water-miscible and water-immiscible solvents especially suitable for attaining the objects of the present invention, there can be mentioned acetone/ethyl acetate, tetrahydrofuran/n-butanol, N,N-dimethylformamide/chloroform, acetone/benzene, tetrahydropyran/carbon tetrachloride/benzene and dioxane/ethyl acetate. Of course, combinations that can be used in the present invention are not limited to those exemplified above.

In the present invention, the mixing ratio of (a) a water-miscible organic solvent and (b) a water-immiscible solvent is changed depending on the kind of binder resin or the kinds of solvents used. However, in order to attain the intended objects of the present invention, it is generally preferred that both solvents (a) and (b) be used at a weight ratio (a) : (b) ranging from 10 : 1 to 1 : 10, especially from 7 : 3 to 3 : 7. The concentration of the binder resin in such organic solvent [(a) + (b)] is selected so that when the formed resin solution having the finely divided magnetic material dispersed therein is incorporated into water, spherical particles in which the finely divided magnetic material is predominantly distributed in the surface layer can be readily formed and a crater-like rough surface can be given to respective particles. In view of the foregoing, in the present invention it is important that the resin concentration in the solvent solution should be 5 to 40% by weight, preferably 10 to 20% by weight.

According to the process of the present invention, the so formed solution or dispersion of the binder resin in a liquid mixture of the water-miscible and water-immiscible solvents is mixed with the above-mentioned amount of the finely divided magnetic material by known dispersing means, such as ultrasonic vibration, a homogenizer and a ball mill. Then, the resulting mixture is mixed under the specific conditions detailed below. Namely, the mixing is conducted under strong shearing agitation sufficient to cause granulation in the mixture, so that sufficient centrifugal force and affinity of water can be applied to the formed particles of the mixture. In this mixing step, water forms a continuous dispersion medium and the resin-magnetic material mixture is present in the form of a spherical dispersoid. The finely divided material present in the spherical dispersoid, because of the centrifugal force and affinity of water, is distributed predominantly in the surface portion of the dispersoid. Simultaneously, the water-miscible organic solvent present in the mixture is transferred (eluted) into the water phase through the interface, and then, the water-immiscible organic solvent is removed from the spherical particles. It is believed that the binder resin-magnetic material mixture is formed into stabilized spherical particles having a desired detailed structure in the foregoing manner. In the present invention, it is also believed that while the finely divided magnetic material is distributed predominantly in the surface layer, the use of the combination of a water-miscible organic solvent provides the effect of keeping the above mixture in a relatively flowable state and that after a certain time lapse, the mixture of the water-miscible and water-immiscible solvents has an action of fixing and stabilizing the attained partial distribution of the magnetic material. A finely divided magnetic material such as triiron teroxide has a higher affinity with an aqueous medium than with an organic solvent, and it is believed that by this property of the finely divided magnetic material, migration and partial distribution of the finely divided magnetic material into the surface layer are promoted. The mechanism of formation of the novel spherical particles of the developer of the present invention may be explained in the foregoing manner.

In the present invention, in order to apply strong shearing agitation to the system of the resin-magnetic material mixture and water and to apply sufficient centrifugal force to the resulting particles of the above mixture, it is generally preferred to use a high speed agitator provided with agitation vanes having a rotation number of 1,000 to 6,000 rpm, especially 2,000 to 4,000 rpm. More specifically, when ultrasonic vibration or an ordinary low speed agitator is utilized for attaining the above objects, sufficient shearing force or centrifugal force cannot be applied to the binder resin-magnetic material mixture, and hence, it is difficult to form the above mixture into spherical particles. In case the rotation number of the agitation vane is too great and exceeds the above-mentioned range, such undesired phenomena as the adhesion of bubbles to the spherical particles and the formation of irregular particles may occur. Therefore the, use of an agitator provided with agitation vanes rotated at a rotation number within the above range is recommended in practising the process of the present invention.

The mixing ratio of the binder resin-magnetic material mixture slurry and water is selected so that the organic solvents in the slurry are readily transferred into the aqueous dispersion medium and formed spherical particles do not adhere to one another but are present in the state independent from one another. In view of the foregoing, it is generally preferred that the aqueous medium be used in an amount at least 20 times the amount of the slurry, especially at least 40 times the amount of the slurry. Conditions for mixing the slurry with the aqueous medium are not particularly critical in the present invention. Namely, the mixing may be accomplished conveniently at room temperature and atmospheric pressure. If desired, it is possible to perform the mixing at an elevated temperature not exceeding the lowest temperature among the boiling point of water (100° C.) and the boiling points of the organic solvents used, or at a lowered temperature or under an elevated or reduced pressure.

The mixing of the binder resin-material mixture slurry and water may be accomplished batchwise by adding dropwise or gradually pouring the slurry into the aqueous medium. It is possible to perform the mixing in a continuous manner by pouring simultaneously the slurry and water into a vessel equipped with an agitator. In the former case, granulation and stabilization of the binder resin-magnetic material mixture are accomplished substantially instantaneously, for example, within 30 seconds. Accordingly, it is possible to stop agitation immediately after completion of the dropwise addition of the slurry. In the latter case, the formed spherical particles are withdrawn from the bottom of the vessel or overflown from the vessel so that the residence time of the charged mixture in the vessel is about 10 seconds or longer.

The spherical particles withdrawn from the high speed agitation device are washed with water according to need and are then dried in vacuo or under atmospheric pressure. The drying conditions are selected so that the binder resin in the particles is not substantially molten.

According to the above-mentioned process of the present invention, there is obtained a novel magnetic toner in which fine powder of a magnetic material is predominantly distributed in surface layer portions of spherical toner particles.

This novel distribution structure of the magnetic toner of the present invention is characterized in that the index of surface distribution (I.D.) expressed by the following formula is at least $10^2$, preferably at least $10^3$:

$$I.D. = (R_2/R_1)$$

wherein $R_1$ stands for a volume resistivity (Ω-cm) of said spherical particles as measured in a magnetic field of about 680 gauss by using a voltage of 1000 V, and $R_2$ stands for a volume resistivity (Ω-cm), as measured in the same manner as above, of spherical particles formed by melting a mixture having the same composition as that of said spherical particles, blending it homogeneously and intimately in the molten state and molding the melt into particles having the same size as that of said spherical particles.

By virtue of ths specific distribution characteristic, an electric conductivity suitable for use in the electrostatic photographic process can be imparted to the magnetic toner particles.

The so prepared spherical toner particles of the present invention have a very high oil absorption because of the above-mentioned specific distribution structure. For example, spherical particles prepared by melting and mixing a finely divided magnetic material and a binder resin and granulating the molten mixture have an oil absorption of 23.9. In contrast, the spherical particles according to the present invention have an oil absorption of 45 to 90, especially 50 to 80, when measured with respect to the same particle size range.

The oil absorption referred to the instant specification is one determined according to JIS K-5101 in the following manner:

A sample (10 g) is charged in a beaker, and purified linseed oil is gradually added dropwise to the sample. Every time a prescribed amount of linseed oil is added, the mixture is kneaded by a glass rod. This dropping and kneading operation is continued until the mixture is drawn upwardly in a rod-like form when the kneading rod is lifted up from the mixture and linseed oil oozes out of the surface of the rod-like mixture. The oil absorption is calculated according to the following equation:

$$\text{Oil Absorption} = (A \times 100)/B$$

wherein A stands for the amount (*g*) of linseed oil added dropwise to the sample and B denotes the amount (*g*) of the sample.

In the spherical particles of the present invention, the electric conductivity can be adjusted to an optional level by surface-treating the spherical toner particles with an inorganic or organic conducting agent.

In the present invention, the following conducting agents are preferably used for such surface treatment.

A. Organic Conducting Agents:

(1) Cationic Conducting Agents:

(1-*a*) Amine Type Conducting Agents:

Primary, secondary and tertiary alkylamines, cycloalkylamines and alkanolamines, their acid addition salts with carboxylic acids, phosphoric acid or boric acid, and polyalkyleneimines, amideamines and polyamines and their complex metal salts.

(1-*b*) Imidazoline Type Conducting Agents:

1-Hydroxyethyl-2-alkylimidazolines and the like.

(1-*c*) Amine-Ethylene Oxide Adducts and Amine-Propylene

Oxide Adducts:

Adducts of ethylene oxide, propylene oxide or other alkylene oxide to mono- or di-alkanolamines, long-chain ($C_{12}$ to $C_{22}$) alkylamines or polyamines.

(1-*d*) Quaternary Ammonium Salts:

Quaternary ammonium salts represented by the following general formula:

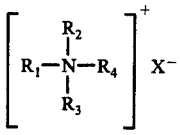

wherein $R_1$ to $R_4$, which may be the same or different, stand for an alkyl group with the proviso that at least 2 of $R_1$ to $R_4$ stand for a lower alkyl group and at least one of $R_1$ to $R_4$ stands for an alkyl group having at least 6 carbon atoms, preferably at least 8 carbon atoms, and $X^{\ominus}$ denotes a halide ion, and quaternary ammonium salts represented by the following general formula:

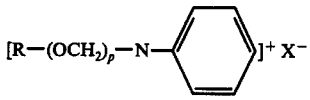

wherein R stands for an alkyl group having at least 12 carbon atoms, *p* is 0 or 1, and X stands for a halide ion.

(1-*e*) Other Cationic Conducting Agents:

Cationic polymers formed by quaternizing polymers of aminoalcohol esters of ethylenically unsaturated carboxylic acids (such as a quaternary ammonium type polymer of diethylaminoethyl methacrylate), acrylamide derivatives (such as a quaternary ammonium type polymer of N,N-diethylaminoethyl acrylamide), vinyl ether derivatives (such as a pyridium salt of polyvinyl-2-chloroethyl ether), nitrogen-containing vinyl derivatives (such as a product formed by quaternizing poly-2-vinylpyridine with p-toluenesulfonic acid), polyamine resins (such as polyethylene glycol polyamine), and polyvinylbenzyltrimethyl ammonium chloride.

(2) Anionic Conducting Agents:

(2-*a*) Sulfonic Acid Type Conducting Agents:

Alkylsulfonic acids, sulfated oils, and salts of higher alcohol sulfuric acid esters.

(2-*b*) Carboxylic Acid Type Conducting Agents:

Adipic acid and glutamic acid.

(2-*c*) Phosphoric Acid Derivative Conducting Agents:

Phosphonic acid, phosphinic acid, phosphite esters and phosphate ester salts.

(2-*d*) Other Anionic Conducting Agents:

Homopolymers and copolymers of ethylenically unsaturated carboxylic acids (such as polyacrylic acid and copolymers of maleic anhydride with comonomers such as styrene and vinyl acetate), and homopolymers and copolymers of sulfonic acid group-containing vinyl compounds (such as polyvinyltoluenesulfonic acid and polystyrenesulfonic acid).

(3) Non-Ionic Conducting Agents:

(3-*a*) Polyether Type Conducting Agents:

Polyethylene glycol and polypropylene glycol.

(3-*b*) Alkylphenol Adduct Type Conducting Agents:

Adducts of ethylene oxide or propylene oxide to alkylphenols.

(3-*c*) Alcohol Adduct Type Conducting Agents:

Adducts of ethylene oxide or propylene oxide to alcohols (such as a higher alcohol-ethylene oxide adduct).

(3-*d*) Ester Type Conducting Agents:

Butyl, amyl and glycerin esters of higher fatty acids such as adipic acid and stearic acid.

(3-*e*) Amide Type Conducting Agents:

Higher fatty acid amides, dialkyl amides, and adducts of ethylene oxide or propylene oxide to these amides.

(3-*f*) Polyhydric Alcohol Type Conducting Agents:

Ethylene glycol, propylene glycol, glycerin, pentaerythritol and sorbitol.

(4) Amphoteric Conducting Agents:

Betain type conducting agents, imidazoline type conducting agents and aminosulfonic acid type conducting agents.

B. Inorganic Conducting Agents:

Alkaline earth metal halides such as magnesium chloride and calcium chloride, inorganic salts such as zinc chloride and sodium chloride, chromium complexes of the Werner type in which trivalent chromium is coordinated with a monobasic acid, and hydrolysis products such as chlorosilane and silicon tetrachloride.

Conducting agents exemplified above may be used singly or in the form thereof a mixture of two or more of. For example, better results are obtained when inorganic conducting agents are used in combination with organic conducting agents capable of acting as binders.

A conducting agent such as exemplified above is dissolved in a liquid medium substantially incapable of dissolving the binder resin of the spherical toner particles to be treated, in general, in water, so that the concentration of the conducting agent is maintained at a suitable level, for example, 0.1 to 0.5%. Then, the surface treatment of the spherical particles is performed by dipping the particles into the so formed solution of the conducting agent or spraying the solution on the spherical particles. The conducting agent may be present in an amount of 0.05 to 20% by weight of the spherical toner particles. It is preferred that the surface treatment of the spherical toner particles be conducted independently from the above-mentioned step of granulization of the resin-magnetic material mixture, but if desired, it is possible to adopt a method in which the conducting agent is dissolved in the aqueous medium for formation of particles of the resin-magnetic material mixture and the surface treatment is conducted simultaneously with the molding of the spherical particles.

The developer of the present invention can be advantageously applied to various electrostatic photographical processes. For example, the developer of the present invention can be applied with ease in the form of a magnetic brush to an electrostatic image formed on a photoconductive layer of zinc oxide, CdS or the like. The toner image formed by the development can easily be fixed under application of heat and/or pressure as it is developed or after it has been transferred onto a suitable transfer paper.

The test method and apparatus used for determining the volume resistivity of the developer in the present invention will now be described.

TEST METHOD:

A sample developer is maintained in a region where a magnetic force acts and it is kept under such conditions that a force other than gravity and magnetic force is not applied to the sample. In this state, the powder is apparently solid but its characteristic flowability is not lost unless under the influence of a very strong magnet. In this state, the powder is contacted with electrodes and the electric resistance is determined according to a customary method. The spacing between the electrodes is correctly measured by using a micrometer. In this manner, the volume resistivity can be determined.

A most preferred method for fixing the sample powder between the electrodes is a method in which a magnet is disposed in parallel to the acting direction of gravity, the sample is attracted and fixed to the lower face of the magnet, and the facing electrodes are moved in the direction perpendicular to the magnetic force line. The adopted test conditions are as follows:

Electrodes: made of brass
Electrode thickness: 1 mm
Magnetic force: about 680 gauss on the surface
Electrode spacing: 1 to 3 mm
Applied voltage: 1,000 V The present invention will now be described in detail by reference to the following Examples that by no means limit the scope of the invention.

EXAMPLE 1

An iron oxide-dispersed resin solution comprising 1 part by weight of triiron tetroxide (manufactured by Toyo Shikiso K.K.), 1 part by weight of EPICLON 4050 (epoxy resin manufactured by Dainippon Ink K.K.), 4 parts by weight of acetone and 4 parts by weight of ethyl acetate was gradually poured into 400 parts by weight of water being agitated at 2000 rpm by a high speed agitator. The precipitated solid was recovered by filtration, washed with water and dried at 40° C. to obtain a toner consisting of spherical particles having an average particle size of 15 $\mu$, in which the iron oxide was predominantly distributed in the surface layer of each particle. The so formed toner was found to have a volume resistivity of $5 \times 10^9$ Ω-cm, an oil absorption of 53.59 and a surface distribution index (I.D.) of $4 \times 10^4$.

By using the so formed toner development was conducted and the toner image was fixed in a magnet dry copying machine (Copistar Model 350 D manufactured by Mita Industrial Co.). The toner image was fixed under a pressure of 350 Kg by using a pair of steel rollers. A copied image excellent in clearness and fixing property was obtained. Fixation could be similarly performed by using a hot roller.

When the above procedures were repeated by changing the rotation number of the agitator to 500 rpm, solids were hardly precipitated and the majority of the mixture formed viscous masses and adhered to the interior of the agitator. When the above procedures were repeated without using the agitator but under irradiation of a ultrasonic wave of 19 HKz, indefinite particles having an average particle size of about 2 $\mu$ were obtained. When development was conducted by using the above copying machine and the so prepared toner, foggy images were obtained.

COMPARATIVE EXAMPLE 1

1 Part by weight of triiron tetroxide and 1 part by weight of EPICLON 4050 were molten an kneaded by a hot roll mill to disperse triiron tetroxide uniformly in the resin, and the dispersion was cooled and pulverized. The pulverized product was passed through a high temperature air current (500° C.) to effect granulation, and the granulated product was sieved to obtain a toner having an average particle size of 15 $\mu$. The surface portion of each particle of the so obtained toner was covered with the resin, and the toner had a volume resistivity of $2.0 \times 10^{14}$ Ω-cm and an oil absorption of 23.9. When development was conducted by using the same copying machine as used in Example 1 and the so prepared toner, images having a high edge effect were obtained. When these images were lightly rubbed with fingers, many of the toner particles fell from the copying paper.

COMPARATIVE EXAMPLE 2

An iron oxide-dispersed resin solution comprising 1 part by weight of triiron tetroxide, 1 part by weight of EPICLON 4050 and 8 parts by weight of acetone was gradually added to 400 parts by weight of water being rotated at 2000 rpm by a high speed agitator. The precipitated solid was recovered by filtration, washed with water and dried at 40° C. to obtain a particulate toner of an indefinite form with a sharp angle having an average particle size of 10 μ. When development was conducted by using the same copying machine as used in Example 1 and the so prepared toner, foggy images were obtained.

chine as used in Example 1 and the so prepared toner, foggy images were obtained.

Results of Example 1 of the present invention and of Comparative Examples 1 to 5 are summarized in Table 1.

Table 1

| Toner | Physical Properties: Volume Resistivity (Ω-cm) | Fixing Pressure (Kg/cm²) | Average Particle Size (μ) | Image Characteristics: Edge Effect | Fog | Sharpness of Fine Lines |
|---|---|---|---|---|---|---|
| Comparative Example 1 | $2.0 \times 10^{14}$ | 400 | 15 (spherical) | observed | not observed | good |
| Comparative Example 2 | $7.9 \times 10^{9}$ | 350 | 10 (indefinite) | not observed | observed | good |
| Comparative Example 3 | $6.5 \times 10^{10}$ | 350 | 100 (spherical) | not observed | not observed | bad |
| Comparative Example 4 | — | — | 50 (indefinite) | — | — | — |
| Comparative Example 5 | $4.1 \times 8$ | 350 | 2 (indefinite) | not observed | observed | good |
| Example 1 | $5.0 \times 10^{9}$ | 350 | 15 (spherical) | not observed | not observed | good |

Notes:
Comparative Example 1: conventional process
Comparative Example 2: process in which a water-miscible organic solvent alone was used
Comparative Example 3: process in which a water-immiscible organic solvent alone was used
Comparative Example 4: process in which the ratio of the pigment to the resin was 20 % by weight
Comparative Example 5: process in which the ratio of the pigment to the resin was 80 % by weight
Example 1: process of the present invention

COMPARATIVE EXAMPLE 3

An iron oxide-dispersed resin solution comprising 1 part by weight of triiron tetroxide, 1 part by weight of EPICLON 4050 and 8 parts by weight of ethyl acetate was gradually added to 400 parts by weight of water being agitated at 2000 rpm by a high speed agitator. After 3 hours, the precipitated solid was recovered by filtration, washed with water and dried at 40° C. to obtain a particulate toner composed of spherical particles having an average particle size of 100 μ. When development was conducted by using the same copying machine as used in Example 1 and the so prepared toner, rough images with less resolving power were obtained.

COMPARATIVE EXAMPLE 4

An iron oxide-dispersed resin solution comprising 0.4 part by weight of triiron tetroxide, 1.6 parts by weight of EPICLON 4050, 4 parts by weight of acetone and 4 parts by weight of ethyl acetate was gradually added to 400 parts by weight of water being agitated at 2000 rpm by a high speed agitator. The precipitated solid was recovered by filtration, washed with water and dried at 40° C. to obtain a particulate toner of an indefinite form having an average particle size of 50 μ. When development was tried by using the same copying machine as used in Example 1 and the so prepared toner, development was impossible because the magnetic force of the toner was too weak.

COMPARATIVE EXAMPLE 5

An iron oxide-dispersed resin solution comprising 1.6 parts by weight of triiron tetroxide, 0.4 part by weight of EPICLON 4050, 4 parts by weight of acetone and 4 parts by weight of ethyl acetate was gradually added to 400 parts by weight of water being agitated at 2000 rpm by a high speed agitator. The precipitated solid was recovered by filtration, washed with water and dried at 40° C. to obtain a particulate toner of an indefinite form having an average particle size of 2 μ. When development was conducted by using the same copying ma-

EXAMPLE 2

An iron oxide-dispersed resin solution comprising 1 part by weight of triiron teroxide, 1 part by weight of Versamid 930 (polyamide resin manufactured by Daiichi General K. K.), 5 parts by weight of tetrahydrofuran and 4 parts by weight of n-butanol was gradually poured into 400 parts by weight of water being agitated at 2000 rpm by using a high speed agitator. The precipitated solid was recovered by filtration, washed with water and dried at 40° C. to obtain a toner consisting of spherical particles having an average particle size of 20 μ, in which the iron oxide was predominantly distributed in the surface layer of each particle. The toner was found to have a volume resistivity of $3.2 \times 10^{8}$ Ω-cm. In the same manner as described in Example 1 development was conducted by using the so obtained developer and the formed visible image was fixed under a pressure of 350 Kg/cm² to obtain a clear copied image having a high fixing power.

The toner image could also be fixed by the heat fixing method using a heating roller.

EXAMPLE 3

A magnesium iron oxide-dispersed resin solution comprising 0.9 part by weight of magnesium iron oxide, 1.1 parts by weight of Himer SU-120 (styrene resin manufactured by Sanyo Kasei K. K.), 6 parts by weight of N,N-dimethylformamide and 2 parts by weight of chloroform was treated in the same manner as described in Example 2 to obtain a toner consisting of spherical particles having an average particle size of 20 μ, in which the magnesium iron oxide was predominantly distributed in the surface layer of each particle. The toner was found to have a volume resistivity of $8.7 \times 10^{7}$ Ω-cm.

By using the so obtained developer, development was conducted in the same manner as described in Example 1, and the toner image was fixed under 350 Kg/cm² by using two steel rollers to obtain a copied image having excellent clearness and fixing property.

The visible image could also be fixed by the heat fixing method using a heating roller.

EXAMPLE 4

A copper iron oxide-dispersed resin solution comprising 1 part by weight of copper iron oxide, 1 part by weight of cyclized rubber (manufactured by Sekisui Kasei K. K.), 0.01 part of $SiO_2$, 5 parts by weight of tetrahydropyran, 2 parts by weight of carbon tetrachloride and 1 part by weight of benzene was treated in the same manner as described in Example 2 to obtain a toner consisting of spherical particles having an average particle size of 15 $\mu$, in which the copper iron oxide was predominantly distributed in the surface layer of each particle. The toner was found to have a volume resistivity of $4.0 \times 10^{10}$ Ω-cm.

In the same manner as described in Example 1, development was conducted by using the so obtained toner and fixation was carried out under a pressure of 350 Kg to obtain a copied image having excellent clearness and fixing property.

EXAMPLE 5

To 2 parts by weight of the toner obtained in Example 1 were added 0.1 part by weight of Anon (amphoteric surface active agent manufactured by Nippon Yushi) and 1 part by weight of water, and the resulting slurry was dried at 40° C. to obtain a toner having a volume resistivity of $8.5 \times 10^7$ Ω-cm. Development was conducted in the same manner as described in Example 1 by using the so prepared toner, and fixation was carried out under a pressure of 350 Kg to obtain a clear copied image having a high fixing power and being free of bleeding.

EXAMPLE 6

A nickel powder-dispersed resin solution comprising 1 part by weight of nickel powder, 1 part by weight of rosin, 0.01 part by weight of Aniline Black, 5 parts by weight of acetone and 2 parts by weight of benzene was treated in the same manner as described in Example 2 to obtain a toner consisting of spherical particles having an average particle size of 20 $\mu$. In this toner, the nickel powder was distributed predominantly in the surface layer portion of each particle, and the toner was found to have a volume resistivity of $2.0 \times 10^6$ Ω-cm. In the same manner as described in Example 1, development was conducted by using the so obtained toner and fixation was carried out under a pressure of 350 Kg/cm$^2$ to obtain a clear copied image having a high fixing power. The visible image could also be fixed by the heat fixing method using a heating roller.

EXAMPLE 7

A $\gamma$-type diiron trioxide-dispersed resin solution comprising 1.2 parts by weight of $\gamma$-type diiron trioxide, 0.6 part by weight of EPICLON 4050, 0.2 part by weight of Piccolastic D-125 (styrene resin manufactured by Pennsylvania Industrial Chemical Corp.), 6 parts by weight of acetone, 1 part by weight of toluene and 1 part by weight of chloroform was treated in the same manner as described in Example 2 to obtain a toner consisting of spherical particles having an average particle size of 20 $\mu$, in which the $\gamma$-type diiron trioxide was distributed predominantly in the surface layer portion of each particle. The toner was found to have a volume resistivity of $3.1 \times 10^9$ Ω-cm. In the same manner as described in Example 1, development was conducted by using the so obtained toner and fixation was carried out under a pressure of 350 Kg to obtain a clear brown image having a high fixing power. The visible image could also be fixed by the heat fixing method using a heating roller.

What we claim is:

1. A magnetic dry toner for electrostatic photography consisting essentially of spherical particles of a composition comprising a fine powder of a magnetic material having a particle size not exceeding 100 m$\mu$ and being dispersed in a binder resin, said powdery magnetic material being triiron tetroxide and being present in an amount of 25 to 75% by weight based on the composition, said binder resin being a synthetic resin which becomes adhesive upon the application of heat or pressure, said spherical particles of said composition having such a particle size distribution that particles having a particle size larger than 44 $\mu$ occupy up to 10% of the total particles and particles having a particle size smaller than 2 $\mu$ occupy up to 10% of the total particles, wherein said fine powder of the magnetic material is distributed predominantly in the surface layer portion of each spherical particle and said spherical particles have a volume resistivity not higher than $1 \times 10^{11}$ Ω-cm as measured in a magnetic field of about 680 gauss under a voltage of 1000 V, and said spherical particles have such a distribution structure that the index of surface distribution (I. D.) expressed by the following formula is at least $10^2$:

$$\text{I. D.} = (R_2/R_1)$$

wherein $R_1$ stands for a volume resistivity (Ω-cm) of said spherical particles as measured in a magnetic field of about 680 gauss under a voltage of 1000 V, and $R_2$ stands for a volume resistivity (Ω-cm), as measured in the same manner as above, of spherical particles formed by melting a mixture having the same composition as that of said spherical particles, blending it homogeneously and intimately in the molten state and molding the melt into particles having the same size as that of said spherical particles.

2. The magnetic toner as set forth in claim 1 wherein said binder resin is a synthetic resin which is adhesive under the application of heat or pressure.

3. The magnetic toner as set forth in claim 2 wherein the synthetic resin is an epoxy resin.

4. The magnetic toner as set forth in claim 1 wherein said spherical toner particles contain a pigment or extender pigment in an amount of up to 10% by weight based on the total composition.

5. The magnetic toner as set forth in claim 1 wherein said spherical particles are formed by mixing the fine powder of said magnetic material with said binder resin dissolved or dispersed in a liquid mixture of a water-miscible organic solvent and a water-immiscible organic solvent, mixing the resulting mixture with an aqueous medium under strong shearing agitation sufficient to cause granulation of the mixture, and then transferring the organic solvents in the particulate mixture into the aqueous medium.

6. The magnetic toner as set forth in claim 1 wherein said spherical particles have a layer of a conducting agent applied on the surface thereof, said conducting agent being an organic conducting agent selected from the group consisting of cationic conducting agents, anionic conducting agents, non-ionic conducting agents and amphoteric conducting agents and the layer of said conducting agent being present in an amount of 0.05 to 20% by weight based on said spherical particles.

7. The magnetic toner as set forth in claim 1 wherein the spherical particles have an oil absorption of 45 to 90.

8. The magnetic toner as set forth in claim 7 wherein said spherical particles have an oil absorption of 50 to 80.

9. The magnetic toner as set forth in claim 1 wherein said powdery magnetic material is present in an amount of 40% to 60% by weight, based on the spherical toner particles.

10. A process for the preparation of dry magnetic toners for electrostatic photography comprising mixing a powdery magnetic material with a binder resin dissolved or dispersed in a liquid mixture of (a) a water-miscible organic solvent, and (b) a water-immiscible organic solvent, the weight ratio (a): (b) ranging from 10:1 to 1:10, the resin concentration in the liquid mixture being from 5 to 40% by weight; mixing the resulting mixture with an aqueous medium under strong shearing agitation sufficient to cause granulation of the mixture, thus transferring the organic solvents in the particulate mixture into the aqueous medium to thereby form substantially spherical particles having a crater-like rough surface in which the powder magnetic material is distributed predominantly in the surface layer portion of each particle; recovering the so formed particles; washing the particles with water; and drying the recovered particles under such conditions that the resin binder is not substantially melted.

11. The process of claim 10, wherein the weight ratio (a) : (b) is from 7:3 to 3:7.

12. The process of claim 10, wherein the resin concentration in the solvent solution is from 10% to 20% by weight.

* * * * *